US007407918B2

(12) United States Patent
Mishra et al.

(10) Patent No.: US 7,407,918 B2
(45) Date of Patent: Aug. 5, 2008

(54) LUBRICATING OIL COMPOSITIONS

(75) Inventors: Munmaya K. Mishra, Richmond, VA (US); William Y. Lam, Glen Allen, VA (US); Sanjay Srinivasan, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 416 days.

(21) Appl. No.: 10/734,034

(22) Filed: Dec. 11, 2003

(65) Prior Publication Data

US 2005/0130853 A1 Jun. 16, 2005

(51) Int. Cl.
*C10M 133/56* (2006.01)

(52) U.S. Cl. ..... 508/291; 508/591

(58) Field of Classification Search ..... 508/291, 508/591

See application file for complete search history.

(56) References Cited

U.S. PATENT DOCUMENTS

| | | | | | |
|---|---|---|---|---|---|
| 3,554,911 | A | | 1/1971 | Schiff et al. | |
| 3,653,273 | A | * | 4/1972 | Albertson et al. | 474/74 |
| 3,668,125 | A | | 6/1972 | Anderson | |
| 3,700,633 | A | | 10/1972 | Wald et al. | |
| 3,772,196 | A | | 11/1973 | St. Clair et al. | |
| 3,775,329 | A | | 11/1973 | Eckert | |
| 3,827,999 | A | | 8/1974 | Crossland | |
| 3,835,053 | A | | 9/1974 | Meier et al. | |
| 3,948,843 | A | | 4/1976 | Saint-Pierre et al. | |
| 3,965,019 | A | | 6/1976 | St. Clair et al. | |
| 4,073,737 | A | | 2/1978 | Elliott | |
| 4,081,390 | A | | 3/1978 | Richardson | |
| 4,162,985 | A | | 7/1979 | Holubec | |
| 4,234,435 | A | | 11/1980 | Meinhardt | |
| 4,418,234 | A | | 11/1983 | Schiff et al. | |
| 4,605,808 | A | * | 8/1986 | Samson | 585/525 |
| 4,620,048 | A | | 10/1986 | Ver Strate et al. | |
| 4,780,228 | A | | 10/1988 | Gardiner et al. | |
| 5,112,508 | A | | 5/1992 | DeRosa et al. | |
| 5,137,980 | A | | 8/1992 | DeGonia et al. | |
| 5,238,588 | A | | 8/1993 | Nalesnik et al. | |
| 5,294,354 | A | | 3/1994 | Papke et al. | |
| 5,393,309 | A | | 2/1995 | Cherpeck | |
| 5,620,486 | A | | 4/1997 | Cherpeck | |
| 5,637,783 | A | | 6/1997 | Brandes et al. | |
| 5,641,731 | A | | 6/1997 | Baumgart et al. | |
| 5,652,201 | A | * | 7/1997 | Papay et al. | 508/228 |
| 5,681,797 | A | | 10/1997 | Lawate | |
| 5,789,353 | A | | 8/1998 | Scattergood | |
| 5,814,586 | A | | 9/1998 | Boden et al. | |
| 5,888,947 | A | * | 3/1999 | Lambert et al. | 508/491 |
| 5,958,848 | A | | 9/1999 | Robson | |
| 6,107,257 | A | | 8/2000 | Valcho et al. | |
| 6,187,721 | B1 | | 2/2001 | Goldblatt et al. | |
| 6,232,279 | B1 | | 5/2001 | Steigerwald | |
| 6,300,444 | B1 | * | 10/2001 | Tokumoto et al. | 526/237 |
| 6,303,550 | B1 | | 10/2001 | Wedlock et al. | |
| 6,365,558 | B2 | | 4/2002 | Lal | |
| 6,503,872 | B1 | | 1/2003 | Tomaro | |
| 6,525,149 | B1 | * | 2/2003 | Baxter et al. | 526/133 |
| 6,548,458 | B2 | | 4/2003 | Loper | |
| 6,627,584 | B2 | | 9/2003 | Ozbalik | |

FOREIGN PATENT DOCUMENTS

| | | | |
|---|---|---|---|
| EP | 0 307 132 | A1 | 3/1989 |
| EP | 0 837 122 | A2 | 4/1998 |
| EP | 1 318 189 | A1 | 6/2003 |
| GB | 2048935 | A * | 12/1980 |
| JP | 2002-220597 | | 8/2002 |
| JP | 2004-107645 | | 4/2004 |

OTHER PUBLICATIONS

Engineering Plastics Network, copy of web page from EnplaNet.com, "Septon™:High Performance Thermoplastic Rubber," Dec. 11, 2003.

* cited by examiner

*Primary Examiner*—Glenn Caldarola
*Assistant Examiner*—Jim Goloboy
(74) *Attorney, Agent, or Firm*—MH2 Technology Law Group LLP

(57) ABSTRACT

A lubricant composition comprising a major amount of baseoil lubricant and a minor amount of lubricant additive. The lubricant additive includes (a) a dispersant containing at least one member selected from hydrocarbyl-substituted succinimides, hydrocarbyl-substituted amines, and Mannich base adducts derived from hydrocarbyl-substituted phenols condensed with an aldehyde and an amine, and (b) a viscosity index improver that includes a substantially linear block copolymer having a number average molecular weight as determined by gel permeation chromatography ranging from about 50,000 to about 250,000. The block copolymer is derived from a conjugated diene monomer containing no less than 5 carbon atoms and a monoalkenylarene monomer, wherein the block copolymer has an aromatic content ranging from about 10 wt. % to about 50 wt. % and an olefinic unsaturation ranging from about 0.5 wt. % to about 5 wt. %.

38 Claims, No Drawings

LUBRICATING OIL COMPOSITIONS

TECHNICAL FIELD

The following disclosure is directed to lubricants and additives therefor for improving rheological properties of the lubricants.

BACKGROUND

The rheological properties of oils, particularly lubricating oils vary with temperature. Since many oils are used over a wide range of temperatures, it is important to preserve the rheological properties of the oils over such a wide range of temperatures. For mineral oil lubricants, additives are typically added to preserve the rheological properties of the oils.

One indication of the rheological properties of a lubricating oil is its temperature/viscosity relationship, referred to herein as "viscosity index," which can be determined using standard techniques. The higher the viscosity index of the oil, the less the viscosity of the oil depends on the temperature. For oils having a low viscosity index, a viscosity index improver composition is included in the oil. However, not all viscosity index improvers perform the same. As uses for lubricating oils continue to expand and become more complex, there continues to be a need for improved lubricant compositions.

SUMMARY OF THE EMBODIMENTS

In one embodiment herein is presented a lubricant composition including a major amount of mineral oil lubricant and a minor amount of lubricant additive. The lubricant additive contains a dispersant containing at least one member selected from the group consisting of hydrocarbyl-substituted succinimides, hydrocarbyl-substituted amines, and Mannich base adducts derived from a hydrocarbyl-substituted phenol condensed with an aldehyde and an amine.

In another embodiment, the hydrocarbyl substituent includes a polymerization product of a raffinate I stream and isobutylene having a number average molecular weight ranging from about 800 to about 1200 as determined by gel permeation chromatography and more than about 70 mol percent of the polymerization product having a terminal vinylidene group. Also included in the additive is a viscosity index improver that includes a substantially linear block copolymer having a number average molecular weight as determined by gel permeation chromatography ranging from about 50,000 to about 250,000. The block copolymer is derived from a conjugated diene monomer containing no less than 5 carbon atoms and a monoalkenylarene monomer. Also, the block copolymer has an aromatic content ranging from about 10 wt. % to about 50 wt. % and an olefinic unsaturation ranging from about 0.5 wt. % to about 5 wt. %.

In another embodiment there is provided a lubricant additive. The lubricant additive contains a dispersant component including:

(a) a first dispersant including at least one member selected from the group consisting of hydrocarbyl-substituted succinimides, hydrocarbyl-substituted amines, and Mannich base adducts derived from a hydrocarbyl-substituted phenol condensed with an aldehyde and an amine; and (b) a second dispersant including a member selected from the group hydrocarbyl-substituted succinimides, hydrocarbyl-substituted amines, and Mannich base adducts derived from a hydrocarbyl-substituted phenol condensed with an aldehyde and an amine, The hydrocarbyl substituent of the first dispersant has a number average molecular weight ranging from about 1500 to about 2500 as determined by gel permeation chromatography. The second dispersant has a number average molecular weight ranging from about 800 to about 1200 as determined by gel permeation chromatography.

Also included in the additive is a viscosity index improver component provided by a substantially linear block copolymer having a number average molecular weight as determined by gel permeation chromatography ranging from about 50,000 to about 250,000. The block copolymer has an A block derived from a monoalkenylarene monomer and a B block derived from a conjugated diene monomer containing no less than 5 carbon atoms. Further, the block copolymer has an aromatic content ranging from about 10 wt. % to about 50 wt. % and an olefinic unsaturation ranging from about 0.5 wt. % to about 5 wt. %.

In yet another embodiment, a method of reducing wear in moving parts is provided. The method includes contacting at least one of the moving parts with a lubricant composition containing a major amount of base oil and a minor viscosity index improving amount of a viscosity index improver. The viscosity index improver includes a substantially linear block copolymer having a number average molecular weight as determined by gel permeation chromatography ranging from about 50,000 to about 250,000. The block copolymer is derived from a conjugated diene monomer containing no less than 5 carbon atoms and a monoalkenylarene monomer. Also, the block copolymer has an aromatic content ranging from about 10 wt. % to about 50 wt. %, and an olefinic unsaturation ranging from about 0.5 wt. % to about 5 wt. %.

An advantage of the embodiments described herein is that it provides improved lubricants for a variety of applications. The lubricants are less prone to viscosity degradation at high temperatures and have improved low temperature characteristics that are critical to smooth engine operation in both high and low temperature environments.

DETAILED DESCRIPTION OF THE PREFERRED EMBODIMENTS

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "sequential block copolymer" is used to mean a copolymer formed from A blocks and B blocks in which the respective A block and B block monomers are present in the individual polymer chains in distinct homopolymeric blocks. Thus the sequential block copolymers have the essential chain structure:

A-A-A-A-A-A-B-B-B-B-B-B-B-B-B-B- (A)

a-a-a-b-b-b-b-b-b-b-b-b-b-a-a-a- (b)

but does not include copolymers known in the art as statistical or alternating copolymers having the chain structures:

A-b-a-b-a-b-a-b-a-b-a-b- (e)

or random copolymers having the chain structure:

A-B-B-A-B-A-A-B-A-B-B-A-B-B- (F).

Base Stock Lubricants

Lubricating base oils useful in preparing the compositions of the present invention include, but are not limited to, the common solvent-treated or acid-treated mineral oils of the paraffinic, naphthenic, or mixed paraffinic-naphthenic types. While mineral oils are typically improved by the viscosity index improver described below, the additive may also be effective in base oils of lubricating viscosity derived from a variety of other sources. For example, the base oil may be derived from both natural and synthetic sources.

Natural base oils include animal oils, such as lard oil; vegetable oils, such as castor oil. Also useful are oils of lubricating viscosity derived from coal or shale.

Many synthetic lubricants are known in the art and are useful as base lubricating oils for lubricant compositions as described herein. Useful synthetic lubricating base oils include hydrocarbon oils derived from the polymerization or copolymerization of olefins, such as polypropylene, polyisobutylene and propylene-isobutylene copolymers; and the halohydrocarbon oils, such as chlorinated polybutylene. Other useful synthetic base oils include those based upon alkyl benzenes, such as dodecylbenzene, tetra-decylbenzene, and those based upon polyphenyls, such as biphenyls and terphenyls.

Another known class of synthetic oils useful as base oils for lubricant compositions described herein are those based upon alkylene oxide polymers and interpolymers, and those oils obtained by the modification of the terminal hydroxy groups of these polymers, (i.e., by the esterification or etherification of the hydroxy groups). Thus, useful base oils are obtained from polymerized ethylene oxide or propylene oxide or from the copolymers of ethylene oxide and propylene oxide. Useful oils include the alkyl and aryl ethers of the polymerized alkylene oxides, such as methylpolyisopropylene glycol ether, diphenyl ether of polyethylene glycol, and diethyl ether of propylene glycol. Another useful series of synthetic base oils is derived from the esterification of the terminal hydroxy group of the polymerized alkylene oxides with mono- or polycarboxylic acids. Exemplary of this series is the acetic acid esters or mixed $C_3$-$C_8$ fatty acid esters or the $C_{13}$ Oxo acid diester of tetraethylene glycol.

Another suitable class of synthetic lubricant includes the esters of dicarboxylic acids, such as phthalic acid, succinic acid, oleic acid, azelaic acid, suberic acid, sebacic acid, with a variety of alcohols. Specific examples of these esters include dibutyl adipate, di(2-ethylhexyl)-sebacate, and the like. Complex esters of saturated fatty acids and a dihydroxy compound, such as 3-hydroxy-2,2-dimethylpropyl 2,2-dimethylhydracrylate (U.S. Pat. No. 3,759,862), are also useful. Silicone based oils such as polyalkyl-, polyaryl-, polyalkoxy-, or polyaryloxy-siloxane oils and the silicate oils, i.e., tetraethyl silicate, comprise another useful class of synthetic lubricants. Other synthetic lubricating oils include liquid esters of phosphorus-containing acid, such as tricresyl phosphate, polymerized tetrahydrofurans, and the like.

Unrefined, refined, and re-refined oils of the type described above are also useful as base oil for the preparation of lubricants. Unrefined oils are those obtained directly from a natural or synthetic source without further purification or treatment. For example, a shale oil obtained directly from retorting operations, a petroleum oil obtained directly from distillation, or an ester oil obtained directly from an esterification process, and used without further treatment are unrefined oils. Refined oils are similar to the unrefined oils, except they have been further treated in one or more purification steps, to improve one or more properties. Many such purification techniques are known in the art, such as solvent extraction, acid or base extraction, filtration, percolation, etc. Rerefined oils are obtained by a variety of processes similar to those used to obtain refined oils. The rerefined oils are also known as reclaimed or reprocessed oils and have been treated by additional techniques directed to the removal of spent additives and oil breakdown products.

Lubricant compositions including the base oil and additives described herein may be formulated for a variety of uses. Thus, lubricants may be formulated as crankcase lubricating oils for spark-ignition and compression-ignition internal combustion engines, including automobile and truck engines, two-cycle engines, aviation piston engines, marine and low-load diesel engines, and the like. Also, the lubricants may be formulated for automatic transmissions, transaxles, gears, metal-working applications, hydraulic fluids, and the like.

Viscosity Index Improver

Lubricating base oil compositions include a major portion of a lubricating oil and a minor portion of an additive as described below. The additive is present in an amount sufficient to improve the rheological properties of the lubricant. In general, an additive for improving the viscosity index of a lubricant is used in an amount of from about 1% to about 95% by weight of the total weight of lubricant composition. The optimum concentration for a particular additive will depend to a large measure upon the type of service the composition is to be subjected. In most applications, lubricant contains from about 0.05% to about 25% by weight viscosity index improver, although for certain applications such as in gear lubricants and diesel engines, the lubricants may containing up to 35% or more viscosity index improver. The optimum concentration of the viscosity index improver depends on the molecular weight, polydispersity, shear stability, and low temperature properties of the viscosity index improper as well as the properties of the base oil and the desired viscosity grade of the lubricant composition.

The viscosity index improver component of the additive for the lubricant compositions described above is a sequential block copolymer, preferably a di-block or a tri-block copolymer represented by the formulas:

$$A_n\text{-}B_m \quad \text{(I)}$$

and $$A_n\text{-}B_m\text{-}A_n \quad \text{(II)}$$

wherein n is the number of A block units in the polymer and m is the number of B block units in the polymer. The number of A blocks and B blocks in the polymer may vary depending on the properties desired. However, the polymer desirably contains at least one A block and one B block and is compatible with lubricating oils as described above.

The viscosity index improver may be further characterized as non-shear stable and shear stable viscosity index improvers. The viscosity index improver is a substantially linear block copolymer having a number average molecular weight as determined by gel permeation chromatography ranging from about 50,000 to about 250,000, preferably from about 100,000 to about 200,000. The B block of the block copolymer is derived from a conjugated diene monomer containing no less than 5 carbon atoms. Such B blocks include branched and straight chain monomers. Branched chain monomers having five carbon atoms are particularly suitable.

The A block of the block copolymer is derived from a monoalkenylarene monomer. The block copolymer is further characterized as having an aromatic content ranging from about 10 wt. % to about 50 wt. %, preferably from about 20 wt. % to about 40 wt. % and an olefinic unsaturation ranging from about 0.5 wt. % to about 5 wt. %, preferably from about 1.5 wt. % to about 3.5 wt. %. Accordingly, a preferred viscosity index improver for a lubricant is composed of a vinyl aromatic/isoprene sequential block copolymer having a number average molecular weight in the range of from about 75,000 to about 200,000 and containing from about 10 to about 50 percent by weight of the vinyl aromatic component.

Vinyl aromatic/isoprene sequential block copolymers may be prepared by techniques well-known in the art. The most common technique is that of anionic polymerization, sometimes known as 'living polymerization' wherein a pre-determined amount of a polymerization initiator such as an organolithium compound, e.g. n- or sec-butyl lithium, dissolved in a hydrocarbon solvent is added to a pre-determined quantity of the vinyl aromatic monomer, preferably in the presence of a diluent, which diluent may be a hydrocarbon solvent, e.g. toluene. After the vinyl aromatic monomer is completely polymerized pure isoprene monomer is added. The non-terminated vinyl aromatic polymer chains initiate polymerization of the isoprene monomer which adds thereto until the isoprene monomer is consumed. If a sequential block copolymer is desired, polymerization is terminated by the addition of a suitable terminating agent, e.g. methanol. The molecular weight of the block copolymer is dependent on the number of moles of monomer and initiator present. Preferably the vinyl aromatic component of the copolymer is styrene.

The vinyl aromatic/isoprene copolymers are then hydrogenated in order to improve their thermal stability. Suitable methods of hydrogenation are described in U.S. Pat. Nos. 3,113,986 and 3,205,278 in which there is employed as catalyst an organo-transition metal compound and trialkylaluminium (e.g. nickel acetylacetone or octoate and triethyl or triisobutylaluminium). The process allows more than 95% of the olefinic double bonds and less than 5% of the aromatic nucleus double bonds to be hydrogenated. Alternatively the method described in U.S. Pat. No. 2,864,809 employing a nickel on kieselguhr catalyst may be employed. After hydrogenation the catalyst may be removed by treating the hydrogenated copolymer with a mixture of methanol and hydrochloric acid. The solution so obtained is decanted, washed with water and dried by passage through a column containing a drying agent.

In addition to the viscosity index improver described above, the lubricant the lubricant base oil may contain other additives known to persons skilled in the art such as corrosion inhibitors, detergents, dispersants, anti-wear agents etc. Dispersants are particularly suitable additives for lubricants used to lubricate moving parts of internal combustion engines.

Dispersants

Dispersants are included in the lubricant compositions, particularly for use in crankcase oils and drive train lubricants for internal combustion engines. The dispersants are dispersants containing hydrocarbyl substituents. Of the hydrocarbyl substituents, olefinic hydrocarbons are particularly preferred for the hydrocarbyl substituent of at least one dispersant. Olefinic hydrocarbons such as isobutene are typically made by cracking a hydrocarbon stream to produce a hydrocarbon mixture of essentially $C_4$-hydrocarbons. For example, thermocracking processes (streamcracker) produce $C_4$ cuts comprising $C_4$ paraffins and $C_4$ olefins, with a major component being isobutene. Butadiene and acetylene are substantially removed from the stream by additional selective hydrogenation or extractive distillation techniques. The resulting stream is referred to as "raffinate I" and is suitable for polyisobutylene (PIB) synthesis and has essentially the following typical composition: 44-49% of isobutene, 24-28% of 1-butene, 19-21% of 2-butene, 6-8% of n-butane, 2-3% of isobutane. The components of the raffinate I stream may vary depending on operating conditions. Purification of the raffinate I stream provides an essentially pure isobutene product.

Until now, relatively low molecular weight PIB for use in making dispersants for lubricant and oil compositions has been derived mainly from polymerization of isobutene. The resulting product typically has a vinylidene group content typically ranging from about 50 to about 60 percent by weight of the polymerization product. The vinylidene group content is believed to have an effect on the reactivity of the PIB during an alkylation process for making a succinic acid adduct, an amine adduct, or an alkyl phenol adduct.

A hydrocarbyl substituent made from the polymerization of a mixture of raffinate I and isobutene has advantages over polyisobutylene (PIB) derived from isobutene alone. For example, such a hydrocarbyl substituent is relatively more reactive than PIB as evidenced by its vinylidene group content. The vinylidene content of a polymerized mixture of raffinate I and isobutene is typically above about 70% by weight. Also, the polymerized mixture, as described herein, provides a hydrocarbyl polymeric chain including a mixture of gem-dimethyl carbon atoms, methylene carbon atoms, mono-methyl substituted carbon atoms, mono-ethyl substituted carbon atoms. In contrast, polymerization of a relatively pure isobutene reactant provides a mixture of gem-dimethyl carbon atoms and methylene carbon atoms only.

A preferred polymerization product is provided by polymerizing a mixture of from about 35 to about 45 percent by weight isobutene with from about 55 to about 65 percent by weight raffinate I stream containing at least about 40% by weight isobutene. The resulting polymerization product has a vinylidene group content of above about 70 percent by weight and preferably, a number average molecular weight ranging from about 800 to about 1200, preferably about 1000 as determined by gel permeation chromatography.

The polymerization reaction used to form the polymerization product is generally carried out in the presence of a conventional Ziegler-Natta or metallocene catalyst system. The polymerization medium can include solution, slurry, or gas phase processes, as known to those skilled in the art. When solution polymerization is employed, the solvent may be any suitable inert hydrocarbon solvent that is liquid under reaction conditions for polymerization of alpha-olefins; examples of satisfactory hydrocarbon solvents include straight chain paraffins having from 5 to 8 carbon atoms, with hexane being preferred. Aromatic hydrocarbons, preferably aromatic hydrocarbons having a single benzene nucleus, such as benzene and toluene; and saturated cyclic hydrocarbons having boiling point ranges approximating those of the straight chain paraffinic hydrocarbons and aromatic hydrocarbons described above, are particularly suitable. The solvent selected may be a mixture of one or more of the foregoing hydrocarbons. When slurry polymerization is employed, the liquid phase for polymerization is preferably liquid propylene. It is desirable that the polymerization medium be free of substances that will interfere with the catalyst components.

Dispersant compositions as described herein include at least first and second dispersants each selected from the group consisting of, but not limited to, ashless dispersants such as hydrocarbyl-substituted succinimides, hydrocarbyl-substituted amines, and Mannich base adducts derived from hydrocarbyl-substituted phenols condensed with aldehydes. The first dispersant preferably has a hydrocarbyl-substituent having a number average molecular weight ranging from about 1800 to about 2500 as determined by gel permeation chromatography, and the second dispersant preferably has a hydrocarbyl-substituent having a number average molecular weight ranging from about 800 to about 1200 as determined by gel permeation chromatography. In a particularly preferred embodiment, the first dispersant is a post treated dispersant and the second dispersant includes a hydrocarbyl-substituent polymerized from a mixture of raffinate I and isobutene as described above.

Hydrocarbyl-substituted succinic acylating agents are used to make hydrocarbyl-substituted succinimides. The hydrocarbyl-substituted succinic acylating agents include, but are not limited to, hydrocarbyl-substituted succinic acids, hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents. Of these compounds, the hydrocarbyl-substituted succinic acids and the hydrocarbyl-substituted succinic anhydrides and mixtures of such acids and anhydrides are generally preferred, the hydrocarbyl-substituted succinic anhydrides being particularly preferred.

Hydrocarbyl substituted acylating agents are made by reacting a polyolefin of appropriate molecular weight (with or without chlorine) with maleic anhydride. Similar carboxylic reactants can be used to make the acylating agents. Such reactants include, but are not limited to, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

Hydrocarbyl-substituted succinic anhydrides are conventionally prepared by heating a mixture of maleic anhydride and an aliphatic olefin at a temperature of about 175° to about 275° C. The molecular weight of the olefin can vary depending upon the intended use of the substituted succinic anhydrides. Typically, the substituted succinic anhydrides will have a hydrocarbyl group of from 8-500 carbon atoms. Friction modifiers, lubricity additives, antioxidants and fuel detergents generally have a hydrocarbyl group of about 8-100 carbon atoms, while substituted succinic anhydrides used to make lubricating oil dispersants will typically have a hydrocarbyl group of about 40-500 carbon atoms. Dispersants having a hydrocarbyl group containing from about 8 to about 150 carbon atoms are referred to herein as "relatively low molecular weight dispersants." Whereas dispersants having a hydrocarbyl group containing more than about 150 carbon atoms up to about 500 carbon atoms are referred to herein as "relatively high molecular weight dispersants." With the very high molecular weight substituted succinic anhydrides, it is more accurate to refer to number average molecular weight (Mn) since the olefins used to make these substituted succinic anhydrides may include a mixture of different molecular weight components resulting from the polymerization of low molecular weight olefin monomers such as ethylene, propylene and isobutylene.

The mole ratio of maleic anhydride to olefin can vary widely. It may vary, for example, from 5:1 to 1:5, a more preferred range is 1:1 to 3:1. With olefins such as polyisobutylene having a number average molecular weight of 500 to 7000, preferably 800 to 3000 or higher and the ethylene-alpha-olefin copolymers, the maleic anhydride is preferably used in stoichiometric excess, e.g. 1.1 to 3 moles maleic anhydride per mole of olefin. The unreacted maleic anhydride can be vaporized from the resultant reaction mixture.

The hydrocarbyl-substituted succinic anhydrides include polyalkyl or polyalkenyl succinic anhydrides prepared by the reaction of maleic anhydride with the desired polyolefin or chlorinated polyolefin, under reaction conditions well known in the art. For example, such succinic anhydrides may be prepared by the thermal reaction of a polyolefin and maleic anhydride, as described in U.S. Pat. Nos. 3,361,673; 3,676,089; and 5,454,964. Alternatively, the substituted succinic anhydrides can be prepared by the reaction of chlorinated polyolefins with maleic anhydride, as described, for example, in U.S. Pat. No. 3,172,892. A further discussion of hydrocarbyl-substituted succinic anhydrides can be found, for example, in U.S. Pat. Nos. 4,234,435; 5,620,486 and 5,393,309. Typically, these hydrocarbyl-substituents will contain from 40 to 500 carbon atoms.

Polyalkenyl succinic anhydrides may be converted to polyalkyl succinic anhydrides by using conventional reducing conditions such as catalytic hydrogenation. For catalytic hydrogenation, a preferred catalyst is palladium on carbon. Likewise, polyalkenyl succinimides may be converted to polyalkyl succinimides using similar reducing conditions.

The polyalkyl or polyalkenyl substituent on the succinic anhydrides employed herein is generally derived from polyolefins which are polymers or copolymers of mono-olefins, particularly 1-mono-olefins, such as ethylene, propylene and butylene. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, polyisobutene, and the polyalphaolefins produced from 1-octene and 1-decene.

Dispersants may be prepared, for example, by reacting the hydrocarbyl-substituted succinic acids or anhydrides with an amine. Preferred amines are selected from polyamines and hydroxyamines. Examples of polyamines that may be used include, but are not limited to, aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine is a mixture of polyalkylenepolyamines comprising small amounts of lower polyamine oligomers such as TEPA and PEHA but primarily oligomers with 7 or more nitrogen atoms, 2 or more primary amines per molecule, and more extensive branching than conventional polyamine mixtures.

Polyamines that are also suitable in preparing the dispersants described herein include N-arylphenylenediamines, such as N-phenylphenylenediamines, for example, N-phenyl-1,4-phenylenediamine, N-phenyl-1,3-phenylendiamine, and N-phenyl-1,2-phenylenediamine; aminothiazoles such as aminothiazole, aminobenzothiazole, aminobenzothiadiazole and aminoalkylthiazole; aminocarbazoles; aminoindoles; aminopyrroles; amino-indazolinones; aminomercaptotriazoles; aminoperimidines; aminoalkyl imidazoles, such as 1-(2-aminoethyl) imidazole, 1-(3-aminopropyl) imidazole; and aminoalkyl morpholines, such as 4-(3-aminopropyl) morpholine. These polyamines are described in more detail in U.S. Pat. Nos. 4,863,623; and 5,075,383. Such polyamines can provide additional benefits, such as anti-wear and antioxidancy, to the final products.

Additional polyamines useful in forming the hydrocarbyl-substituted succinimides include polyamines having at least one primary or secondary amino group and at least one tertiary amino group in the molecule as taught in U.S. Pat. Nos. 5,634,951 and 5,725,612. Examples of suitable polyamines include N,N,N",N"-tetraalkyldialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N',N",N'"-pentaalkyltrialkylenetetramines (one terminal tertiary amino group, two internal tertiary amino groups and one terminal secondary amino group), tris(dialkylaminoalkyl) aminoalkylmethanes (three terminal tertiary amino groups and one terminal primary amino group), and like compounds, wherein the alkyl groups are the same or different and typically contain no more than about 12 carbon atoms each, and which preferably contain from 1 to 4 carbon atoms each. Most preferably these alkyl groups are methyl and/or ethyl groups. Preferred polyamine reactants of this type include dimethylaminopropylamine (DMAPA) and N-methyl piperazine.

Hydroxyamines suitable for herein include compounds, oligomers or polymers containing at least one primary or secondary amine capable of reacting with the hydrocarbyl-substituted succinic acid or anhydride. Examples of hydroxyamines suitable for use herein include aminoethylethanolamine (AEEA), aminopropyldiethanolamine (APDEA), ethanolamine, diethanolamine (DEA), partially propoxylated hexamethylene diamine (for example HMDA-2PO or HMDA-3PO), 3-amino-1,2-propanediol, tris(hydroxymethyl)aminomethane, and 2-amino-1,3-propanediol.

The mol ratio of amine to hydrocarbyl-substituted succinic acid or anhydride preferably ranges from 1:1 to about 2.5:1. A particularly preferred mol ratio of amine to hydrocarbyl-substituted succinic acid or anhydride ranges from about 1.5:1 to about 2.0:1.

The foregoing dispersant may also be a post-treated dispersant made, for example, by treating the dispersant with maleic anhydride and boric acid as described, for example, in U.S. Pat. No. 5,789,353 to Scattergood, or by treating the dispersant with nonylphenol, formaldehyde and glycolic acid as described, for example, in U.S. Pat. No. 5,137,980 to DeGonia, et al.

The Mannich base dispersants are preferably a reaction product of an alkyl phenol, typically having a long chain alkyl substituent on the ring, with one or more aliphatic aldehydes containing from 1 to about 7 carbon atoms (especially formaldehyde and derivatives thereof), and polyamines (especially polyalkylene polyamines). Examples of Mannich condensation products, and methods for their production are described in U.S. Pat. Nos. 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

The preferred hydrocarbon sources for preparation of the Mannich polyamine dispersants are those derived from substantially saturated petroleum fractions and olefin polymers, preferably polymers of mono-olefins having from 2 to about 6 carbon atoms. The hydrocarbon source generally contains at least about 40 and preferably at least about 50 carbon atoms to provide substantial oil solubility to the dispersant. The olefin polymers having a GPC number average molecular weight between about 600 and 5,000 are preferred for reasons of easy reactivity and low cost. However, polymers of higher molecular weight can also be used. Especially suitable hydrocarbon sources are isobutylene polymers and polymers made from a mixture of isobutene and a raffinate I stream.

The preferred Mannich base dispersants for this use are Mannich base ashless dispersants formed by condensing about one molar proportion of long chain hydrocarbon-substituted phenol with from about 1 to 2.5 moles of formaldehyde and from about 0.5 to 2 moles of polyalkylene polyamine.

Polymeric polyamine dispersants suitable as the ashless dispersants are polymers containing basic amine groups and oil solubilizing groups (for example, pendant alkyl groups having at least about 8 carbon atoms). Such materials are illustrated by interpolymers formed from various monomers such as decyl methacrylate, vinyl decyl ether or relatively high molecular weight olefins, with aminoalkyl acrylates and aminoalkyl acrylamides. Examples of polymeric polyamine dispersants are set forth in U.S. Pat. Nos. 3,329,658; 3,449,250; 3,493,520; 3,519,565; 3,666,730; 3,687,849; and 3,702,300. The preferred polymeric polyamines are hydrocarbyl polyamines wherein the hydrocarbyl group is composed of the polymerization product of isobutene and a raffinate I stream as described above. PIB-amine and PIB-polyamines may also be used.

As set forth herein, a lubricant composition according to the embodiments described herein includes a mixture of a first dispersant and a second dispersant, and a viscosity index improver. The first and second dispersants may be each selected from a hydrocarbyl substituted succinimide, Mannich base dispersant provided by condensing a hydrocarbyl substituted phenol with formaldehyde and a polyalkylene polyamine, and a hydrocarbyl substituted amine. At least one of the first and second dispersants preferably has a number average molecular weight ranging from about 1800 to about 2200, and at least one of the first and second dispersants preferably has a number average molecular weight ranging from about 800 to about 1200 as determined by gel permeation chromatography. Most preferably, the lower molecular weight dispersant contains a hydrocarbyl group derived from a polymerization product of isobutene and a raffinate I stream.

Mixtures of the first and second dispersants may be made by combining the components in a conventional manner. It is preferred that the higher molecular weight dispersant be present in the mixture in an amount ranging from about 30 to about 70% by weight, most preferably from about 45 to about 65% by weight of the total weight of the mixed dispersants.

Accordingly, the lower molecular weight dispersant is preferably present in the mixture in an amount ranging from about 70 to about 30% by weight, most preferably from about 35 to about 45% by weight of the total weight of the mixed dispersants. The total amount of dispersant in a lubricant formulation preferably ranges from about 1 to about 10% by weight, more preferably from about 3 to about 6% by weight of the total lubricant formulation weight.

Commercially available dispersants according to the embodiments described above include, but are not limited to:

HiTEC® 644 dispersant is a 1000 $MW_N$ PIBSA plus a polyamine.

HiTEC® 646 dispersant is a 1300 $MW_N$ PIBSA plus a polyamine.

HiTEC® 1921 dispersant is a 2100 $MW_N$ PIBSA plus a polyamine post treated with nonylphenol, formaldehyde, and glycolic acid and having a 1.6 SA/PIB mol ratio.

HiTEC® 643 dispersant is a 1300 $MW_N$ PIBSA plus a polyamine wherein the dispersant was post treated with maleic anhydride and boric acid.

HiTEC® 1919 dispersant is a 2100 $MW_N$ PIBSA plus a polyamine post treated with nonylphenol, formaldehyde, and glycolic acid HiTEC® 1932 dispersant is a 2100 $MW_N$ PIBSA plus a polyamine having a 1.6 SA/PIB ratio.

HiTEC® 7049 dispersant is a 2100 $MW_N$ PIB-phenol Mannich reaction product.

All of the foregoing dispersants are available from Ethyl Corporation of Richmond, Va. "PIBSA" is defined as polyisobutylene succinic acid or anhydride. The "SA/PIB" ratio is the number of moles of succinic acid or anhydride relative to the number of mols of PIB in the PIBSA adduct.

Dispersant mixtures may be made as shown in the following table 1 which are merely representative of mixtures that may be made and used as described herein and are not intended to limit the embodiments described herein in any way.

TABLE 1

| HiTEC ® 1919 (wt. %) | HiTEC ® 1921 (wt. %) | HiTEC ® 1932 (wt. %) | HiTEC ® 644 (wt. %) | PIB-amine 1000 $MW_N$ (wt. %) | PIB-Phenol Mannich 1000 $MW_N$ (wt. %) |
|---|---|---|---|---|---|
| 3.8 | — | — | 1.6 | — | — |
| — | 3.8 | — | — | 1.6 | — |
| — | — | 3.8 | — | — | 1.6 |
| 3.8 | — | — | — | 1.6 | — |
| 3.8 | — | — | — | — | 1.6 |
| — | 3.8 | — | 1.6 | — | — |
| — | 3.8 | — | — | — | 1.6 |
| — | 2.5 | — | 2.6 | — | — |
| — | 3.5 | — | 2.0 | — | — |
| — | — | 3.8 | 1.6 | — | — |
| — | — | 3.8 | — | 1.6 | — |
| 1.6 | — | — | 3.8 | — | — |
| — | 1.6 | — | — | 3.8 | — |
| — | — | 1.6 | — | — | 3.8 |
| 1.6 | — | — | — | 3.8 | — |
| 1.6 | — | — | — | — | 3.8 |
| — | 1.6 | — | 3.8 | — | — |
| — | 1.6 | — | — | — | 3.8 |
| — | — | 1.6 | 3.8 | — | — |
| — | — | 1.6 | — | 3.8 | — |

Formulations were prepared including a dispersant inhibitor pack as described above and a viscosity index improver as indicated in the following tables to illustrate benefits of the use of a styrene isoprene viscosity index improver as described herein. Blend studies were conducted on experimental GF-4 10W40 passenger car motor oils in API Group II formulations. The API stay in grade kinematic viscosity (KV) limits for 10W40 motor oil after 30 Bosch Shear cycles as described in ASTM 6278-02 is 11.5 centistokes (cSt) at 100° C. The cold crank simulator results (CCS) at −25° C. in centipoise (cP) are also shown in the following table.

TABLE 2

GF-4 10W40 Formulations

| Component Identification | Blend 1 Wt. % | Blend 2 Wt. % | Blend 3 Wt. % |
|---|---|---|---|
| Dispersant Inhibitor Pack | 12.00 | 12.00 | 12.00 |
| Olefin copolymer VII (6 wt. % active) | 12.50 | 13.10 | 0.00 |
| Styrene isoprene copolymer VII (4 wt. % active) | 0.00 | 0.00 | 22.00 |
| Baseoil A (Group II) | 20.50 | 20.90 | 12.00 |
| Baseoil B (Group II) | 55.00 | 54.00 | 54.00 |
| Total | 100.00 | 100.00 | 100.00 |
| KV @ 100° C., (cSt) | 15.08 | 15.53 | 15.65 |
| CCS @ −25° C., (cP) | 6962 | 6887 | 6070 |
| KV @ 100° C., (cSt) (after 30 cycles Bosch Shear) | 11.39 | 11.59 | 12.15 |
| % shear | 25.10 | 25.40 | 22.40 |

As illustrated by the foregoing formulations, a lubricant composition (Blend 3) containing a styrene isoprene copolymer VII exhibited lower cold crank viscosity (CCS) and had a passing grade with respect to the API stay in grade requirements after shear cycles. The Blend 1 formulation failed the API stay in grade requirements. Formulations containing an olefin copolymer VII may be able to pass the Bosch shear test by increasing the amount of olefin copolymer in the formulation, however increasing the amount of olefin copolymer in the formulation may result in the formulation exceeding the cold crank simulator viscosity of 7000 cP resulting in the formulation failing the test. Even though Blend 3 contained more copolymer in the formulation, the cold crank viscosity was significantly lower than the CCS for Blends 1 and 2.

In the following table, a comparison of the cold crank viscosity of formulations containing an olefin copolymer VII and a styrene isoprene copolymer VII are given.

TABLE 3

GF-4 5W30 Formulations

| Component Identification | Blend 1 Wt. % | Blend 2 Wt. % | Blend 3 Wt. % |
|---|---|---|---|
| Dispersant Inhibitor Pack | 9.70 | 9.70 | 9.70 |
| Olefin copolymer VII (8.2 wt. % active) | 9.50 | 0.00 | 0.00 |
| Styrene isoprene copolymer VII (7 wt. % active) | 0.00 | 16.10 | 14.10 |
| Baseoil A (Group II) | 7.80 | 1.20 | 7.20 |
| Baseoil B (Group II) | 18.00 | 18.00 | 22.00 |
| Baseoil C (Group III) | 55.00 | 55.00 | 47.00 |
| Total | 100.00 | 100.00 | 100.00 |
| KV @ 100° C., (cSt) | 10.92 | 11.79 | 10.78 |
| CCS @ −25° C., (cP) | 4889 | 4428 | 4829 |

As illustrated by the foregoing blends, a lubricant blend containing a styrene isoprene copolymer VII provided a lower cold crank viscosity (CCS) (Blend 2 compared to Blend 1) than a formulation containing an olefin copolymer VII. Also, a formulation containing a styrene isoprene copolymer VII enabled use of less of the more expensive Group III base oil (Blend 3 compared to Blend 1) while providing a similar or slightly lower cold crank viscosity (CCS).

The foregoing dispersant and viscosity index improver additives used in formulating lubricant compositions described herein can be blended into a baseoil in various sub-combinations. However, it is preferable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

One embodiment is directed to a method of reducing wear in an internal combustion engine, wherein said method comprises using as the crankcase lubricating oil for said internal combustion engine a lubricating oil containing the mixture of dispersants and viscosity index improvers as described herein, wherein the additives are present in an amount sufficient to reduce the wear in an internal combustion engine operated using said crankcase lubricating oil, as compared to the wear in said engine operated in the same manner and using the same crankcase lubricating oil except that the oil is devoid of the dispersant mixture and/or viscosity index improver. Accordingly, for reducing wear, the additive mixture is typically present in the lubricating oil in an amount of from 5 to 50 weight percent based on the total weight of the oil. Representative of the types of wear that may be reduced using the compositions described herein include cam wear and lifter wear.

At numerous places throughout this specification, reference has been made to a number of U.S. Patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A method of reducing wear in an internal combustion engine, comprising:

using as the crankcase lubricating oil for said engine a lubricant composition comprising:

a major amount of base oil;

a first dispersant and a second dispersant each independently comprising at least one member selected from the group consisting of hydrocarbyl-substituted succinimides, hydrocarbyl-substituted amines, and Mannich base adducts derived from hydrocarbyl-substituted phenols condensed with aldehydes and amines;

wherein the hydrocarbyl substituent of the first dispersant has a number average molecular weight ranging from about 1500 to about 2500 as determined by gel permeation chromatography, wherein the hydrocarbyl substituent of the second dispersant has a number average molecular weight ranging from about 800 to about 1200 as determined by gel permeation chromatography, and wherein the hydrocarbyl-substituent of at least one of the first and second dispersants comprises a polymerization product derived from a reaction mixture comprising (i) from about 55 to about 65 weight percent raffinate I stream and (ii) from about 35 to about 45 weight percent isobutylene, with the proviso that (i) and (ii) are different; and a minor viscosity index improving amount of a non-shear stable viscosity index improver comprising a substantially linear block copolymer having a number average molecular weight as determined by gel permeation chromatography ranging from about 50,000 to about 250,000, the block copolymer being derived from a conjugated diene monomer containing no less than 5 carbon atoms and a styrene monomer, wherein the block copolymer has a styrene content ranging from about 30 wt. % to about 40 wt. %, and an olefinic unsaturation ranging from about 0.5 wt. % to about 5 wt. %.

2. The method of claim 1, wherein the conjugated diene monomer comprises isoprene.

3. The method of claim 1, wherein the internal combustion engine is a gasoline or diesel internal combustion engine.

4. The method of claim 1, wherein at least one of the first and second dispersants comprises a hydrocarbyl-substituted succinic acid derivative.

5. The method of claim 1, wherein the first dispersant is a post treated dispersant.

6. The method of claim 1, wherein at least one of the first and second dispersants comprises a Mannich base adduct derived from a hydrocarbyl-substituted phenol condensed with an aldehyde and an amine.

7. A method for lubricating a crankcase in an internal combustion engine comprising:

using in said crankcase a lubricant composition comprising a mineral oil base stock and a lubricant additive in an amount sufficient to enhance the dispersability of particles in the lubricant composition, the lubricant additive comprising:

(a) a first dispersant and a second dispersant each independently comprising at least one member selected from the group consisting of hydrocarbyl-substituted succinimides, hydrocarbyl-substituted amines, and Mannich base adducts derived from a hydrocarbyl-substituted phenol condensed with an aldehyde and an amine;

wherein the hydrocarbyl substituent of the first dispersant has a number average molecular weight ranging from about 1500 to about 2500 as determined by gel permeation chromatography, wherein the hydrocarbyl substituent of the second dispersant has a number average molecular weight ranging from about 800 to about 1200 as determined by gel permeation chromatography, and wherein the hydrocarbyl-substituent of at least one of the first and second dispersants comprises the polymerization product of a reaction mixture comprising (i) from about 55 to about 65 weight percent raffinate I stream and (ii) from about 35 to about 45 weight percent isobutylene, with the proviso that (i) and (ii) are different; and (b) a viscosity index improver comprising a substantially linear block copolymer having A number average molecular weight as determined by gel permeation chromatography ranging from about 50,000 to about 250,000, the block copolymer being derived from a conjugated diene monomer containing no less than 5 carbon atoms and a styrene monomer, wherein the block copolymer has a styrene content ranging from about 30 wt. % to about 40 wt. %, and an olefinic unsaturation ranging from about 0.5 wt. % to about 5 wt. %.

8. The method of claim 7, wherein the conjugated diene monomer comprises isoprene.

9. The method of claim 7, wherein at least one of the first and second dispersants comprises a hydrocarbyl-substituted succinic acid derivative.

10. The method of claim 7, wherein the first dispersant is a post treated dispersant.

11. The method of claim 7, wherein at least one of the first and second dispersants comprises a Mannich base adduct derived from a hydrocarbyl-substituted phenol condensed with an aldehyde and an amine.

12. A method of reducing wear in an internal combustion engine comprising:

using as the automatic transmission fluid for said engine a fluid composition comprising a mineral oil base stock and an additive in an amount sufficient to enhance the dispersability of particles in the lubricant composition, the additive comprising:

(a) a first dispersant and a second dispersant each independently comprising at least one member selected from the group consisting of hydrocarbyl-substituted succinimides, hydrocarbyl-substituted amines, and Mannich base adducts derived from a hydrocarbyl-substituted phenol condensed with an aldehyde and an amine;

wherein the hydrocarbyl substituent of the first dispersant has a number average molecular weight ranging from about 1500 to about 2500 as determined by gel permeation chromatography, wherein the hydrocarbyl substituent of the second dispersant has a number average molecular weight ranging from about 800 to about 1200 as determined by gel permeation chromatography, and wherein the hydrocarbyl-substituent of at least one of the first and second dispersants comprises the polymerization product of a reaction mixture comprising (i) from about 55 to about 65 weight percent raffinate I stream and (ii) from about 35 to about 45 weight percent isobutylene, with the proviso that (i) and (ii) are different; and (b) a viscosity index improver comprising a substantially linear block copolymer having a number average molecular weight as determined by gel permeation chromatography ranging from about 50,000 to about 250,000, the block copolymer being derived from a conjugated diene monomer containing no less than 5 carbon atoms and a styrene monomer, wherein the block copolymer has a styrene content ranging from about 30 wt. % to about 40 wt. %, and an olefinic unsaturation ranging from about 0.5 wt. % to about 5 wt. %.

13. The method of claim 12, wherein the conjugated diene monomer comprises isoprene.

14. The method of claim 12, wherein at least one of the first and second dispersants comprises a hydrocarbyl-substituted succinic acid derivative.

15. The method of claim 12, wherein the first dispersant is a post-treated dispersant.

16. The method of claim 12, wherein the at least one of the first and second dispersants comprises a Mannich base adduct derived from a hydrocarbyl-substituted phenol condensed with an aldehyde and an amine.

17. The method of claim 12, wherein the additive comprises the first dispersant in an amount ranging from about 45% to about 65% by weight, relative to the total weight of the additive composition.

18. The method of claim 12, wherein the additive comprises the second dispersant in an amount ranging from about 35% to about 45% by weight, relative to the total weight of the additive composition.

19. The method of claim 12, wherein the fluid composition comprises from about 1% to about 10% by weight of total dispersant, relative to the total weight of the fluid composition.

20. The method of claim 12, wherein the fluid composition comprises from about 3% to about 6% by weight of total dispersant, relative to the total weight of the fluid composition.

21. A method for lubricating moving parts in a drive train of an internal combustion engine comprising:

using as the lubricating oil for said drive train a lubricant composition comprising a mineral oil base stock and a lubricant additive in an amount sufficient to enhance the dispersability of particles in the lubricant composition, the lubricant additive comprising:

(a) a first dispersant and a second dispersant each independently comprising at least one member selected from the group consisting of hydrocarbyl-substituted succinimides, hydrocarbyl-substituted amines, and Mannich base adducts derived from a hydrocarbyl-substituted phenol condensed with an aldehyde and an amine;

wherein the hydrocarbyl substituent of the first dispersant has a number average molecular weight ranging from about 1500 to about 2500 as determined by gel permeation chromatography, wherein the hydrocarbyl substituent of the second dispersant has a number average molecular weight ranging from about 800 to about 1200 as determined by gel permeation chromatography, and wherein the hydrocarbyl-substituent of at least one of the first and second dispersants comprises the polymerization product of a reaction mixture comprising (i) from about 55 to about 65 weight percent raffinate I stream and (ii) from about 35 to about 45 weight percent isobutylene, with the proviso that (i) and (ii) are different; and (b) a viscosity index improver comprising a substantially linear block copolymer having a number average molecular weight as determined by gel permeation chromatography ranging from about 50,000 to about 250,000, the block copolymer being derived from a conjugated diene monomer containing no less than 5 carbon atoms and a styrene monomer, wherein the block copolymer has a styrene content ranging from about 30 wt. % to about 40 wt. %, and an olefinic unsaturation ranging from about 0.5 wt. % to about 5 wt. %.

22. The method of claim 21, wherein the moving parts comprise a transaxle or gear.

23. The method of claim 22, wherein the conjugated diene monomer comprises isoprene.

24. The method of claim 22, wherein at least one of the first and second dispersants comprises a hydrocarbyl-substituted succinic acid derivative.

25. The method of claim 22, wherein the first dispersant is a post-treated dispersant.

26. The method of claim 22, wherein the at least one of the first and second dispersants comprises a Mannich base adduct derived from a hydrocarbyl-substituted phenol condensed with an aldehyde and an amine.

27. The method of claim 22, wherein the lubricant additive comprises the first dispersant in an amount ranging from about 45% to about 65% by weight, relative to the total weight of the additive composition.

28. The method of claim 22, wherein the lubricant additive comprises the second dispersant in an amount ranging from about 35% to about 45% by weight, relative to the total weight of the additive composition.

29. The method of claim 22, wherein the lubricant composition comprises from about 1% to about 10% by weight of total dispersant, relative to the total weight of the lubricant composition.

30. The method of claim 22, wherein the lubricant composition comprises from about 3% to about 6% by weight of total dispersant, relative to the total weight of the lubricant composition.

31. The method of claim 1, wherein the lubricant composition comprises from about 1% to about 10% by weight of total dispersant, relative to the total weight of the lubricant composition.

32. The method of claim 1, wherein the lubricant composition comprises from about 3% to about 6% by weight of total dispersant, relative to the total weight of the lubricant composition.

33. The method of claim 1, wherein the lubricant additive comprises the first dispersant in an amount ranging from about 45% to about 65% by weight, relative to the total weight of the additive composition.

34. The method of claim 1, wherein the lubricant additive comprises the second dispersant in an amount ranging from about 35% to about 45% by weight, relative to the total weight of the additive composition.

35. The method of claim 7, wherein the lubricant composition comprises from about 1% to about 10% by weight of total dispersant, relative to the total weight of the lubricant composition.

36. The method of claim 7, wherein the lubricant composition comprises from about 3% to about 6% by weight of total dispersant, relative to the total weight of the lubricant composition.

37. The method of claim 7, wherein the lubricant additive comprises the first dispersant in an amount ranging from about 45% to about 65% by weight, relative to the total weight of the additive composition.

38. The method of claim 7, wherein the lubricant additive comprises the second dispersant in an amount ranging from about 35% to about 45% by weight, relative to the total weight of the additive composition.

* * * * *